US010569296B2

(12) United States Patent
Masson

(10) Patent No.: US 10,569,296 B2
(45) Date of Patent: Feb. 25, 2020

(54) METHOD, DEVICE AND APPARATUS FOR COATING AN INNER SURFACE OF A SUBSTRATE

(71) Applicant: UMICORE AG & CO. KG, Hanau-Wolfgang (DE)

(72) Inventor: Stéphane Masson, Village Neuf (FR)

(73) Assignee: UMICORE AG & CO. KG, Hanau-Wolfgang (DE)

( * ) Notice: Subject to any disclaimer, the term of this patent is extended or adjusted under 35 U.S.C. 154(b) by 0 days.

(21) Appl. No.: 15/565,180

(22) PCT Filed: Apr. 21, 2015

(86) PCT No.: PCT/EP2015/058613

§ 371 (c)(1),
(2) Date: Oct. 9, 2017

(87) PCT Pub. No.: WO2016/169590

PCT Pub. Date: Oct. 27, 2016

(65) Prior Publication Data

US 2018/0099308 A1 Apr. 12, 2018

(51) Int. Cl.
*B05D 1/18* (2006.01)
*B05D 7/22* (2006.01)

(52) U.S. Cl.
CPC *B05D 1/18* (2013.01); *B05D 7/22* (2013.01)

(58) Field of Classification Search
None
See application file for complete search history.

(56) References Cited

U.S. PATENT DOCUMENTS

2003/0044520 A1* 3/2003 Kiessling ..... B01J 35/04 427/79
2012/0315381 A1* 12/2012 Mergner ..... F01N 3/2828 427/8
2012/0321537 A1 12/2012 Mergner et al.

FOREIGN PATENT DOCUMENTS

| | | | |
|---|---|---|---|
| DE | 102010007499 | A1 | 8/2011 |
| JP | H03-157142 | A | 7/1991 |
| JP | H07-328454 | A | 12/1995 |
| JP | 2000-343015 | A | 12/2000 |
| WO | 97/48500 | | 12/1997 |

OTHER PUBLICATIONS

International Search Report for International Application No. PCT/EP2015/058613 dated Feb. 8, 2016.

(Continued)

*Primary Examiner* — Shamim Ahmed
*Assistant Examiner* — Bradford M Gates
(74) *Attorney, Agent, or Firm* — Smith, Gambrell & Russell, LLP

(57) ABSTRACT

The invention relates to a method for performing a coating process of a workpiece (4), comprising the steps of:
providing the workpiece (4) in a coating unit (2);
prefilling (S2) the coating unit (2) with a coating medium using a pump (6);
filling (S3) the coating unit (2) with the coating medium by a dosing unit (5), wherein a predetermined amount of coating medium is applied to the coating unit (2) by the dosing unit (5) as soon the coating medium level has reached a given reference level (R).

18 Claims, 3 Drawing Sheets

(56) References Cited

OTHER PUBLICATIONS

Written Opinion of the International Searching Authority for International Application No. PCT/EP2015/058613 dated Feb. 8, 2016.
Japanese Office Action dated Mar. 4, 2019 for Application No. JP 2017-554461 (3 pages in Japanese with English translation).

* cited by examiner

METHOD, DEVICE AND APPARATUS FOR COATING AN INNER SURFACE OF A SUBSTRATE

TECHNICAL FIELD

The present invention relates to the field of coating, particularly coating of inner surfaces of the substrate, such as formed by through-channels through a body.

BACKGROUND ART

Catalysts for use in automotive appliances, such as for catalyzing exhaust fumes of combustion engines or the like, comprise a body having a plurality of inner channels through which the exhaust gas is made to flow. The inner surfaces of the channels are coated with a catalytic material which catalytically supports a chemical reaction of components of the exhaust fumes as being well-known in the art.

In manufacturing of such catalysts, the inner surfaces of channels in a workpiece are coated with a coating medium, such as a washcoat and/or a coating slurry containing the corresponding catalytic material. The inner surfaces are brought into contact with the coating medium so that a layer of the coating medium is applied onto the inner surfaces of the body. Depending on the kind of coating process, the height varies up to which the coating medium shall be introduced into the channels. As the height of the coating medium within the channel cannot be accurately measured, equally applying the coating medium on a predetermined portion of the length of the channels is difficult.

Conventional approaches provide to bring the openings of one side of the substrate into contact with the coating medium and to draw the liquid coating medium through the channels of the substrate by applying a vacuum to the opposite side of the substrate. By means of a predetermined pressure, the coating may be generally applied onto a portion of the length of the channels.

If the coating medium is brought into the channels of the workpiece by pressure from below, then level sensors may be used to obtain an indication of a reference level. The reference level together with a predetermined position of the workpiece may define the total filling volume between the reference level and the liquid coating level up to which the coating shall be applied onto the inner surfaces of the substrate.

However, the channels through the substrate usually have a low cross-section, the total filling volume is also low and therefore a dosing unit has to be applied, as coating medium pumps cannot provide the required accuracy. Although dosing units may be suitable to accurately provide a predetermined amount of coating medium into a coating unit, the flow rate of the coating medium provided by the dosing unit is slow, so that the overall cycle time for coating a workpiece is high.

On the other hand, accurately dispensing of a predetermined amount of coating medium by adjusting a pumping rate of a coating medium pump or by switching respective valves is too inaccurate with respect to the low inner volumes of the workpieces to be filled.

It is therefore an object of the present invention to provide a method and apparatus for partly coating an inner surface of a workpiece which provides a low cycle time and a high accuracy.

SUMMARY OF THE INVENTION

This and further objects have been achieved by the described method for partly coating an inner surface of a substrate in a coating unit and by the described apparatus.

Further embodiments are also described herein.

According to a first aspect, a method for performing a coating process of a workpiece is provided, comprising the steps of:

providing the workpiece in a coating unit;

prefilling the coating unit with a coating medium using a pump;

filling the coating unit with the coating medium by a dosing unit, wherein a predetermined amount of coating medium is applied to the coating unit by the dosing unit as soon as the coating medium level has reached a given reference level.

A coating unit in which a workpiece shall be applied with a coating has a chamber in which the workpiece to be coated is placed. By filling the coating unit with a predetermined amount of the liquid coating medium, the level of the coating medium within and around the workpiece can be determined. For coating the workpiece, therefore, the coating unit including the chamber may firstly be empty, the workpiece to be coated is placed therein and a predetermined amount of coating medium is introduced so that the respective portion of the inner and outer surfaces of the workpiece is covered by the coating medium and thereby the material of the coating medium forms a coating layer on the surfaces of the workpiece.

Between each coating cycle, the chamber may be emptied e.g. by means of a vacuum unit. Due to varying quality and characteristics of the coating medium, such as its viscosity, its "stickiness" and the like, the amount of coating medium which remains in the chamber varies. Filling the same amount of coating medium for each coating cycle therefore results in a varying amounts of coating medium in the coating unit and consequently to different levels up to which a coating is applied on the inner and/or outer surfaces of the workpiece.

According to the above method, the accuracy of the introduced amount of coating medium used for each coating cycle is substantially improved by using the time instance the reference level is reached and the capability of the dosing unit to accurately measure a predetermined amount of coating medium. Particularly, the coating cycle has a prefilling step and filling step.

The prefilling step includes the filling of coating medium into the chamber up to the filling level which is below particularly just below the reference level. The reference level is the level which is defined by the arrangement of a level sensor in or at the chamber so that the level sensor may indicate that the coating medium has reached the reference level when filled into the chamber.

The workpiece may have inner surfaces to be coated. Such a workpiece may be placed in the coating unit so that lower openings of inner channels or inner volumes are located as close as possible to the reference level so that the volume or respectively the amount of coating medium which is needed to fill the space between the reference level to the level up to which the inner surfaces shall be applied with coating medium is kept low. This allows to apply a dosing unit which has a good accuracy so that the coating level of the inner surfaces of the workpiece can be finely set.

The combination of the dosing unit and the level sensor allow to accurately set the coating level up to which the coating medium arises in the chamber of the coating unit and, since the workpiece is placed in a defined position, up to which level the inner volumes of the workpiece are coated.

Applying the process described above, the cycle time is mainly affected by the time the dosing unit needs to apply the specific amount of coating medium into the coating unit. By the two-step filling approach as described above, the amount of coating medium dosed by the dosing unit is substantially reduced so that the cycle time can be kept low while obtaining a substantially increased accuracy.

Furthermore, prefilling may be performed up to a filling level of the chamber of the coating unit which is below the reference level.

It may be provided that prefilling is stopped by closing a valve cutting the pump from the coating unit.

Moreover, the reaching of the coating medium level at a reference level may be signaled by a level sensor arranged in the chamber of the coating unit.

It may be provided that the step of prefilling the coating unit with the coating medium using a pump is performed for a predetermined prefill duration. So, the prefilling step may be time-controlled so that by the pumping rate of the pump which supplies the coating medium into the coating unit and the time the supply of the coating medium is enabled, the amount of coating medium flowing into the chamber of the coating unit is coarsely defined so that the level of the coating medium is just below the reference level.

According to an embodiment the predetermined prefill duration may be determined by emptying the chamber after each filling, iteratively adapting the prefill duration for a number of times so that coating medium level in the chamber is just below the reference level.

According to a further aspect a coating apparatus for coating a workpiece is provided, comprising:

- a coating unit with a chamber for receiving a coating medium, wherein the coating unit is configured to place the workpiece;
- a pump for supplying the coating medium to the coating unit;
- a dosing unit for supplying the coating medium to the coating unit and being configured to measure a specific amount of coating medium;
- a control unit which is configured
- to prefill the coating unit with a coating medium using the pump;
- to fill the coating unit with the coating medium by means of the dosing unit,
- to operate the dosing unit to supply a predetermined amount of the coating medium to the coating unit as soon the coating medium level has reached a given reference level.

Furthermore, the coating unit may have a level sensor which is arranged to signal when the coating medium has reached the reference level in the chamber.

A coating medium tank may be provided which forms a recirculation path with the pump, wherein the recirculation path has a branch off to the dosing unit for filling the dosing unit with the coating medium.

It may be provided that the dosing unit has an adjustable volume to store coating medium, wherein the dosing unit is configured to allow the pump to supply the coating medium through the chamber to the coating unit.

Moreover, the coating medium may include one of a washcoat and a suspension including a catalytic material.

It may be provided that a pumping rate of the pump is higher than the pumping rate of the dosing unit.

According to a further aspect the above coating apparatus is used for partly coating a workpiece up to a predetermined level, wherein the predetermined amount of the coating medium is determined by the volume to be filled from the reference level to the level the workpiece is to be coated.

BRIEF DESCRIPTION OF THE DRAWINGS

Embodiments are further described in more detail in conjunction with the accompanying drawings in which.

DESCRIPTION OF EMBODIMENTS

Figure 1:
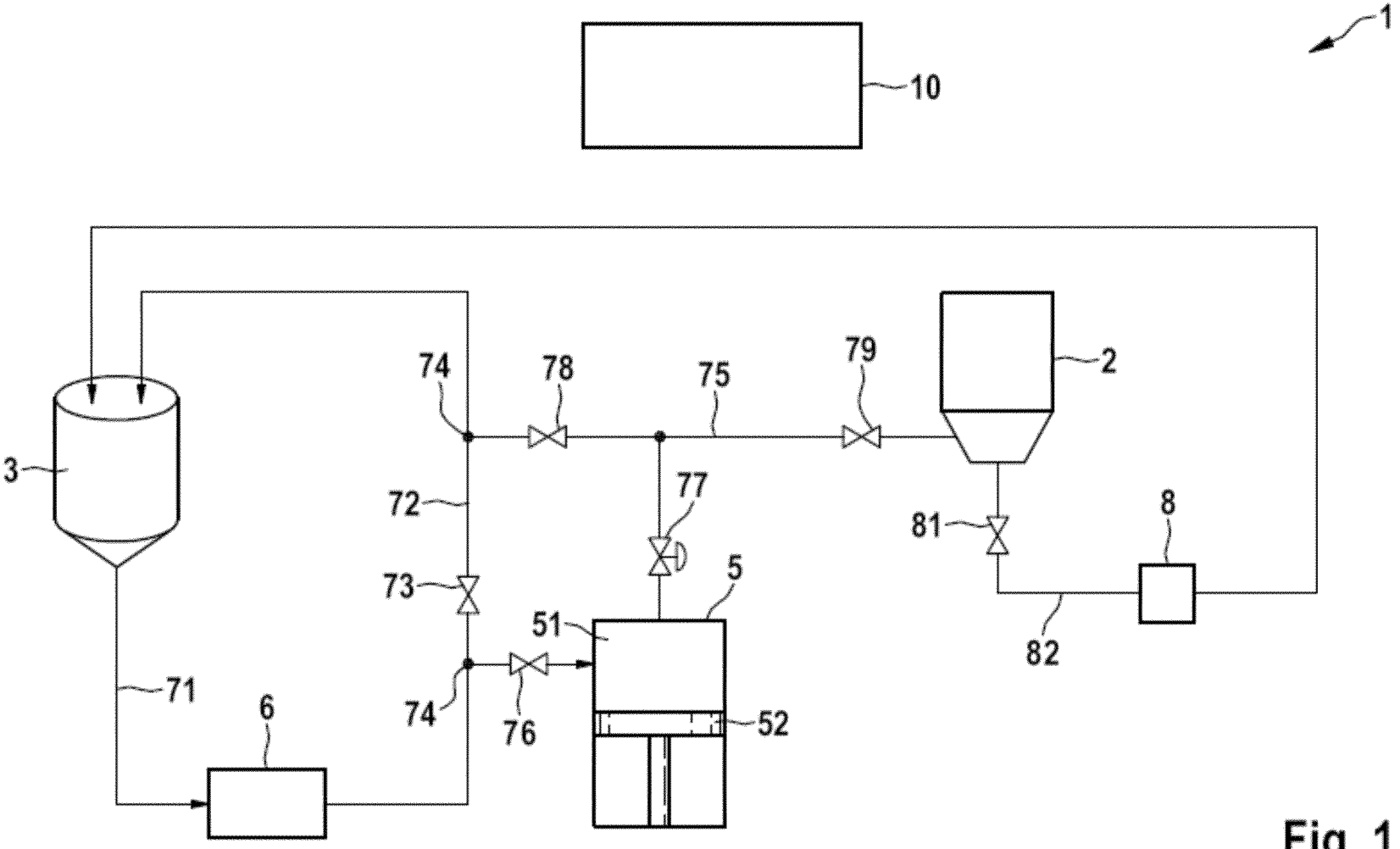
FIG. 1 schematically shows a coating apparatus for cyclically performing a coating process of a workpiece in a coating unit.

FIG. 1 shows a coating apparatus 1. The coating apparatus 1 has a coating unit 2 in which workpieces 4 shall be partly coated. Particularly, inner surface of workpieces 4 shall be applied with a liquid coating medium so that the inner surfaces are coated. The workpieces 4 form substrates for the coating process which may be provided as monoliths or any other kind of basic parts to be coated. As an example for workpieces 4 to be coated is a ceramic substrate with a plurality of straight inner channels 43 passing through from a first face side 41 to a second face side 42. The coated workpiece 4 may form a catalyst for an exhaust gas system of an automotive combustion engine.

The liquid coating medium to be applied on the workpiece 4 may be a washcoat or a suspension including catalytic material to be applied as a coating on the inner surfaces of the workpiece 4. The coating medium is supplied from a coating medium tank 3 which holds and stores the liquid coating medium.

Figure 2:
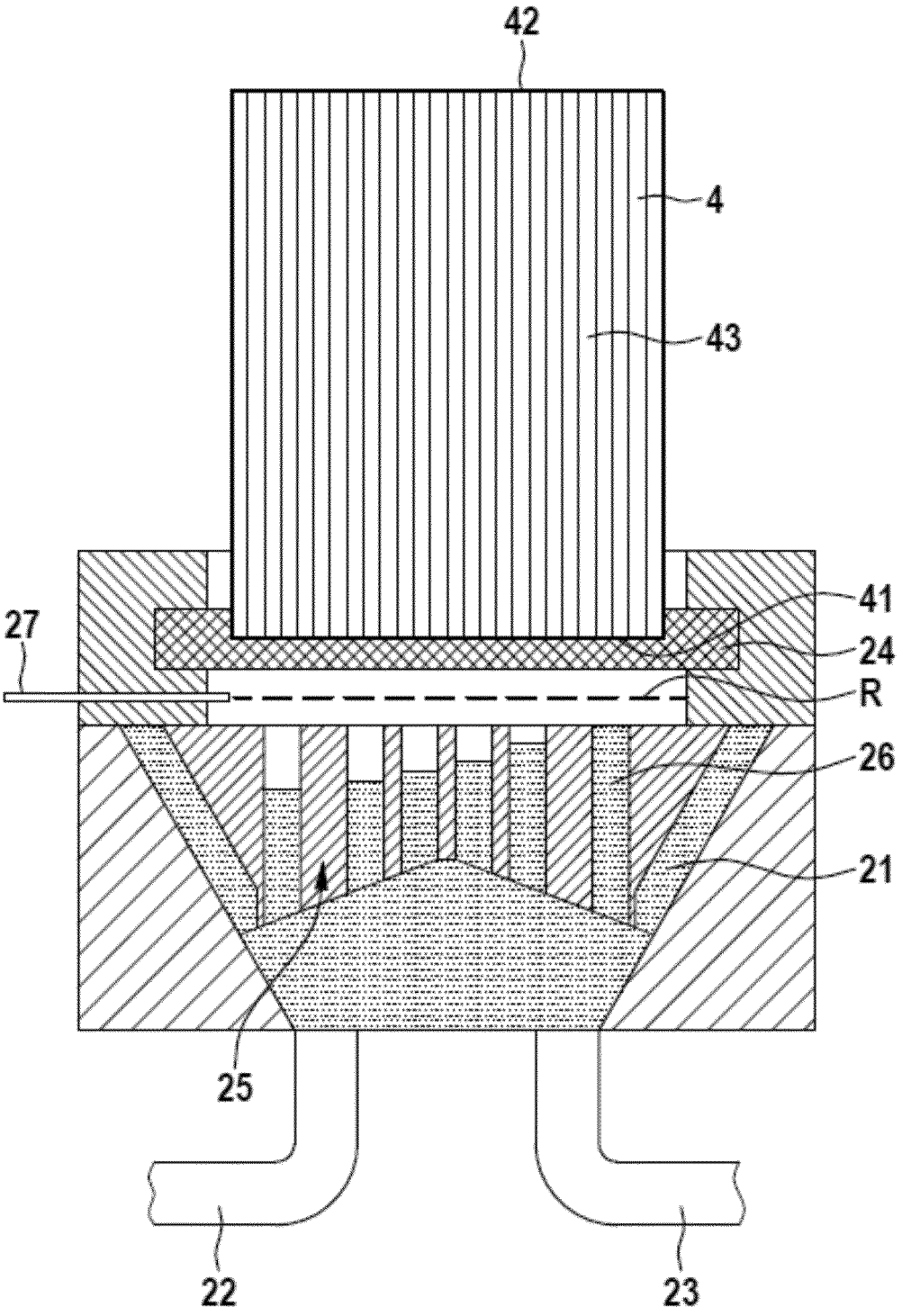
FIG. 2 shows a cross-sectional view of a coating unit with a workpiece inserted.

As shown in FIG. 2, the coating unit 2 has a chamber 21 which can be filled by a filling fluid conduit 22 and which can be emptied by an emptying fluid conduit 23. Instead of the filling fluid conduit 22 and the emptying fluid conduit 23 a single conduit for filling and emptying can be applied. On an upper opening of the chamber 21, a holder 24 is placed which is configured to hold the workpiece 4 with its first face side parallel to a horizontal direction. The holder 24 is configured so that the workpiece 4 can be hold so that channel openings at the first face side 41 are not covered by any part of the holder 24.

The liquid coating medium supplied to the chamber 21 via the filling fluid line 22 therefore provides a fluid surface which is substantially in parallel to the first face side 41 of the workpiece 4. Within the chamber 21, a diffusor 25 may be provided which has a number of parallel channels 26 and which serves to provide an even and bubbleless liquid surface of the coating medium being supplied into the chamber 21.

The chamber 21 includes a level sensor 27 which detects when the filling level of the liquid coating medium has reached a predetermined reference level R. The level sensor 27 is placed so that the reference level R is slightly below the first face side of the workpiece 4 when it is placed in the holder 24.

The quantity of coating medium in the chamber 21 which is not used, i.e. which does not remain as coating on the workpiece 4 is removed from the chamber 21 and returned to the coating medium tank 3. In the present embodiment, the emptying fluid conduit 23 of the chamber 21 may be connected with a vacuum unit 8 via a conduit having a suction valve 81 so that the coating medium can be removed from the chamber 21 when the suction valve 81 is opened and the vacuum unit 8 is operated.

A dosing unit 5 is provided which has an adjustable volume 51 to be filled with the coating medium. By adapting the adjustable volume 51 of the dosing unit 5, the coating medium can be stored and supplied with a predetermined flow rate and with a predetermined amount with a high accuracy. The dosing unit 5 substantially may have a piston 52 which can be hydraulically, pneumatically or electrically actuated to vary the adjustable volume 51 of the dosing unit 5 with high accuracy.

The coating medium tank 3, the dosing unit 5 and the coating unit 2 are interconnected to supply a predetermined amount of coating medium into the coating unit 2 in each coating cycle. Therefore, the coating medium tank 3 is connected via a conduit with a circulation pump 6 which permanently circulates the coating medium through a circulation conduit 72 which forms a recirculation path. The circulation conduit 72 has a bypass valve 73 arranged downstream of branch 74.

Circulation conduit 72 is connected at branch 74 to dosing unit 5 via supply valve 76. So, when the supply valve 76 is opened, the dosing unit 5 can be loaded with the liquid coating medium. With the supply valve 76 opened, the adjustable volume 51 of the dosing unit 5 may be filled by the pressure caused by the pump 6.

Furthermore, an output of the dosing unit 5 is connected via a line mode valve 77 with a conduit 75 connecting the circulation conduit 72 with the coating unit 2. Within the conduit 75, a recirculation valve 78 and a feeding valve 79 are applied, wherein the feeding valve 79 is placed close to the coating unit 2 to allow the coating medium to flow or not to flow into the coating unit 2 depending on its switching state.

The valves are controlled by a control unit 10 which substantially carries out the coating process.

Figure 3:
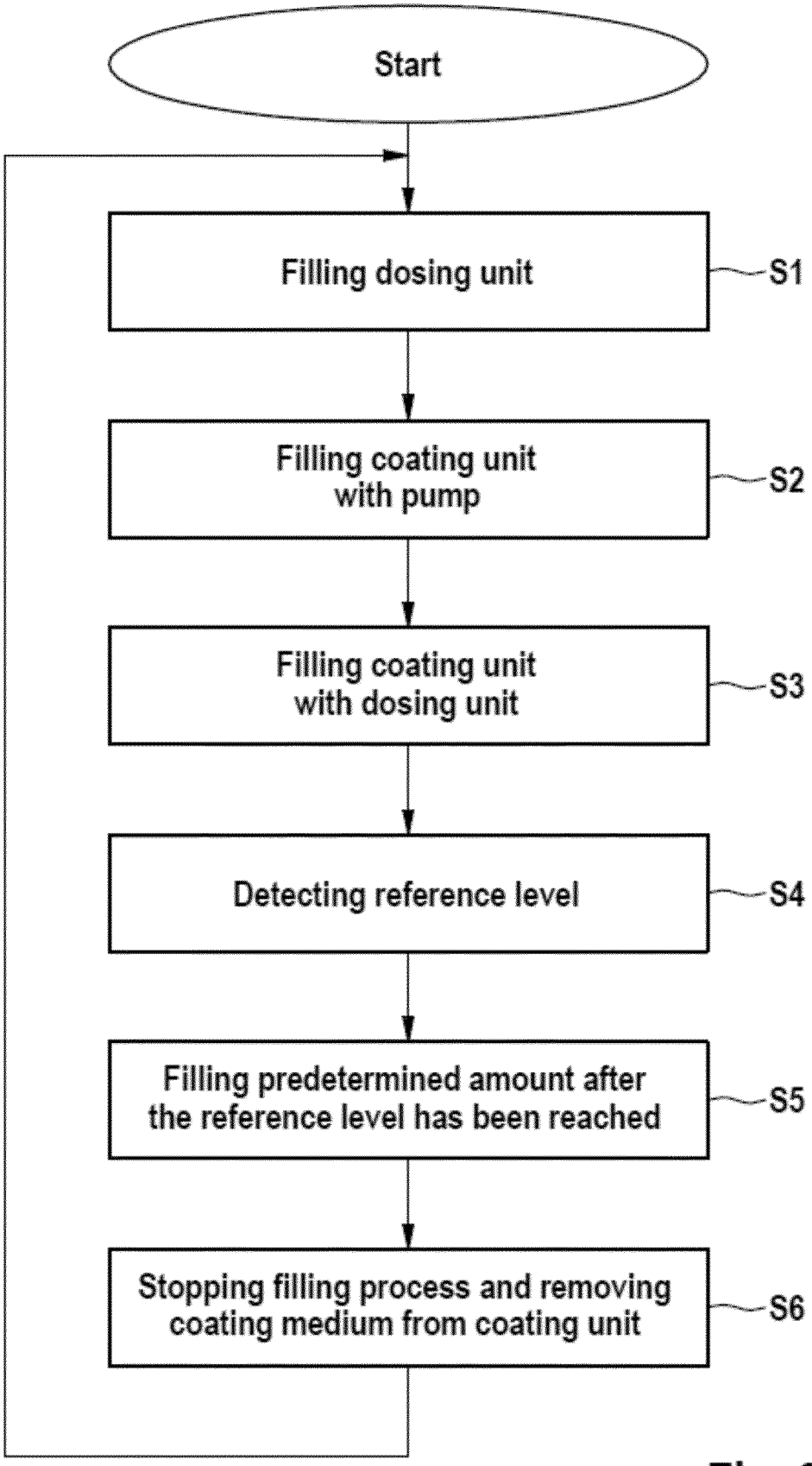
FIG. 3 shows a flowchart of a method for coating a workpiece in the coating unit of FIG. 2.

The operation of the coating apparatus 1 is described in conjunction with the flowchart of FIG. 3. The coating process is performed in cycles in each of which one or more workpieces are simultaneously coated in one or more coating units 2, respectively. After a cycle has ended, the coated workpiece is removed from the coating unit 2 and a new uncoated workpiece is placed therein.

In step S1, the dosing unit 5 is filled and the coating medium circulates between the pump 6 and the coating medium tank 3. The circulation of the coating medium is through the dosing unit 5, the piston 52 of which is moved out so that the adjustable volume 51 of the dosing unit 5 increases and preferably reaches its maximum volume.

The circulation of the coating medium is through the pump 6 through the opened supply valve 76 through the dosing unit 5 and from the output of the dosing unit 5 through the opened line mode valve 77 and the opened recirculation valve 78 back to the coating medium tank 3 while the bypass valve 73 and the feeding valve 79 are closed.

Once the dosing unit 5 is filled, which can be detected by a respective sensor of the dosing unit 5 (not shown) or by the setting a duration for which the pump 6 supplies coating medium into the dosing unit 5, the process is continued with step S2.

In step S2, the recirculation valve 78 is closed and the feeding valve 79 is opened so that the pump 6 delivers the coating medium through the dosing unit 5, the opened second line mode valve 77, the conduit 75 and the feeding valve 79 into the coating unit 2. Thereby, the chamber 21 is filled.

Step S2 is performed for a predetermined prefill duration which has been set according to a method for calibration as will be described below. During the filling of the chamber 21 of the coating unit 2 in step S2, the piston 51 of the dosing unit 5 is not moved so that the dosing unit 5 merely acts as a pass through. So the amount of coating medium filled into the coating unit 2 is coarsely determined by the pump rate of the pump 6 and the prefill duration for which the supply valve 76 is kept opened.

After the predetermined duration of step S2, in step S3 the supply valve 76 is closed and the dosing unit 5 starts supplying the stored coating medium. Therefore the piston 52 is moved to reduce the adjustable volume of the dosing unit 5. The adjustable volume 51 in which the coating medium is held is thereby reduced. The coating medium is supplied through the outlet of the dosing unit 5, the second line mode valve 77, the conduit 75 and the feeding valve 79 to the coating unit 2.

While the chamber 21 is further filled by the operation of the dosing unit 5 of step S3, in step S4 the level sensor 27 is monitored by the control unit 10. When the coating medium level in the chamber 21 reaches the reference level defined by the arrangement of the level sensor 27, the control unit 10 has a reference for the filling level in the chamber 21. As soon as the reaching of the reference level has been detected, it is known that a predetermined amount of coating medium is needed to further fill the chamber up to a level which has been predetermined and up to which the inner surfaces of the workpiece 4 shall be coated.

From the detection of the reaching of the reference level, in step S5 the piston 52 is further actuated to constantly reduce the adjustable volume 51 of the dosing unit 5 with a predetermined rate and for a predetermined duration, so that from the time of signaling that the reference level has been reached by the coating medium level, a predetermined amount of coating medium is supplied to the coating unit 2. After the predetermined amount of coating medium has been pushed out of the adjustable volume 51 by the piston 52, it is therefore known that the coating medium level in the coating unit 2 has achieved the filling level which is needed to apply the coating on the portions of the surfaces of the workpiece 4. In other words, the predetermined amount of coating medium is defined by the flow rate of coating medium output by the dosing unit and the predetermined duration for which the dosing unit 5 is made further filling the chamber 21 after the reference level has been reached.

After the coating medium has been filled into the chamber 21 for the predetermined duration, in step S6 the operation of the dosing unit 5 is stopped and the feeding valve 79 is closed while the recirculation valve 78 is opened to start filling the adjustable volume 51 again. The process returns to step S1.

After the chamber 21 has been filled up to the predetermined filling level, the chamber will be emptied. To empty the chamber 21, the suction valve 81 may be opened so that the vacuum unit 8 removes the coating medium from the chamber 21. The removed coating medium may be returned to the coating medium tank 3. Alternative methods for emptying the chamber 21 can be applied as well.

The optimum duration for performing the prefill step S2 can be iteratively found in a calibration routine. The iteration is performed so that the amount of coating medium filled into the coating unit 2 during the step S2 is so that the coating medium level within the chamber is just below the reference level R which is detected by the level sensor 27.

The prefill duration thereby ensures that the reference level will be reached by providing coating medium in step S3 but not in step S2.

The calibration of the predetermined prefill duration can be made in conjunction with an adjusting of a flow rate of the circulation pump 6 so that it can be ensured that step S2 does not result in the formation of air bubbles in the coating medium in the chamber 21. The calibration routine can be performed initially and/or periodically between two coating cycles to adjust to differing quantities and characteristics of the coating medium which is applied.

The invention claimed is:

1. Method for performing a coating process of a workpiece (4), comprising the steps of:

providing the workpiece (4) in a coating unit (2);

prefilling (S2) the coating unit (2) with a coating medium using a pump (6);

filling (S3) the coating unit (2) with the coating medium by a dosing unit (5), wherein a predetermined amount of coating medium is applied to the coating unit (2) by the dosing unit (5) as soon as the coating medium level has reached a given reference level (R), and wherein the dosing unit comprises a piston and a dosing unit container within which the piston is adjustable, and prefilling involves pumping coating medium with the pump through the dosing unit container while the piston is not moving.

2. Method according to claim 1, wherein prefilling is performed up to a filling level of a chamber (21) of the coating unit (2) which is below the reference level (R).

3. Method according to claim 1, wherein prefilling is stopped by closing a valve (76) cutting the pump (6) from the coating unit (2).

4. Method according to claim 1, wherein the reaching of the coating medium level at the reference level (R) is signaled by a level sensor (27) arranged in the chamber of the coating unit (2).

5. Method according to claim 1, wherein the step of prefilling the coating unit (2) with the coating medium using a pump (6) is performed for a predetermined prefill duration.

6. Method according to claim 5, wherein the predetermined prefill duration is determined by emptying the chamber (21) after each filling, iteratively adapting the prefill duration for a number of times so that coating medium level in the chamber (21) of the coating unit is below the reference level (R).

7. Coating apparatus (1) for coating a workpiece (4), comprising:

a coating unit (2) with a chamber (21) for receiving a coating medium, wherein the coating unit (2) is configured to place the workpiece (4);

a pump (6) for supplying the coating medium to the coating unit (2);

a dosing unit (5) for supplying the coating medium to the coating unit (2) and being configured to measure a specific amount of coating medium;

a control unit (10) which is configured to prefill the coating unit (2) with a coating medium using the pump (6);

to fill the coating unit (2) with the coating medium by means of the dosing unit (5), to operate the dosing unit (5) to supply a predetermined amount of the coating medium to the coating unit (2) as soon as the coating medium level has reached a given reference level (R), and wherein the control unit is configured to run the dosing unit while the pump is off.

8. Coating apparatus (1) according to claim 7, wherein the coating unit (2) has a level sensor (27) which is arranged to signal when the coating medium has reached the reference level (R) in the chamber (21).

9. Coating apparatus according to claim 8, further comprising a workpiece holder that is configured to support the workpiece from below and wherein the reference level falls within the coating unit below both a lower end of the workpiece and a region of the holder that is in contact with the workpiece.

10. Coating apparatus (1) according to claim 7, wherein a coating medium tank (3) is provided which forms a recirculation path with the pump (6), wherein the recirculation path has a branch off to the dosing unit (5) for filling the dosing unit (5) with the coating medium.

11. Coating apparatus (1) according to claim 7, wherein the dosing unit (5) has an adjustable volume chamber (51) to store coating medium, wherein the dosing unit (5) is configured to allow the pump (6) to supply the coating medium through the adjustable volume chamber (51) of the dosing unit to the coating unit (2).

12. Coating apparatus (1) according to claim 7, wherein the dosing unit is in communication with the control unit that is configured for dosing a coating medium that includes a washcoat or a suspension including a catalytic material.

13. Coating apparatus (1) according to claim 7, wherein a pumping rate of the pump (6) is higher than a pumping rate of the dosing unit (5).

14. A method of operating the coating apparatus (1) according to claim 7 for partly coating a workpiece (4) up to a predetermined level, wherein the predetermined level is reached by supplying an amount of the coating medium that is determined by the volume to be filled from the reference level (R) to a level of the workpiece (4) to be coated.

15. Coating apparatus according to claim 7, wherein the dosing unit comprises a piston and a dosing unit container within which the piston is adjustable as to define an adjustable volume chamber (51) of the dosing unit, and the adjustable volume chamber is positioned in line with the pump such that prefilling involves pumping coating medium with the pump through the adjustable volume chamber of the dosing unit container while the piston is not moving.

16. Coating apparatus according to claim 7, wherein the control unit is configured to maintain the dosing unit in a non-operational state during prefilling with the pump.

17. A method for performing a coating process of a workpiece, comprising:

providing the workpiece in a coating unit;

prefilling the coating unit with a coating medium using a pump;

switching from prefilling with the pump to filling the coating unit utilizing a dosing unit, and wherein, upon the dosing unit supplying sufficient coating medium to reach a given reference level within the coating unit, further operating the dosing unit such that a predetermined amount of coating medium is supplied to the coating unit by the dosing unit, which predetermined amount is sufficient to coat the workpiece to a predetermined height, and wherein a filling rate of the pump is higher than that of the dosing unit, and the dosing unit operates at a time when them pump is not operating and the pump operates at a time when the dosing unit is not operating.

18. The method of claim 17 wherein the coating medium comprising a liquid, catalytic material.

* * * * *